US007556566B2

(12) United States Patent
Shin

(10) Patent No.: US 7,556,566 B2
(45) Date of Patent: Jul. 7, 2009

(54) PORTABLE PUTTING PRACTICE DEVICE

(76) Inventor: Ick Hwan Shin, No. 202, Joongang Heights Villa, 8-1, Singyo-dong, Jongno-gu, Seoul (KR)

( * ) Notice: Subject to any disclaimer, the term of this patent is extended or adjusted under 35 U.S.C. 154(b) by 0 days.

(21) Appl. No.: 12/031,216

(22) Filed: Feb. 14, 2008

(65) Prior Publication Data

US 2008/0200272 A1 Aug. 21, 2008

(30) Foreign Application Priority Data

Feb. 16, 2007 (KR) ..... 20-2007-0002818 U

(51) Int. Cl.
*A63B 69/36* (2006.01)

(52) U.S. Cl. ..... 473/162

(58) Field of Classification Search ..... 473/157–164, 473/181

See application file for complete search history.

(56) References Cited

U.S. PATENT DOCUMENTS 1,952,187 A * 3/1934 Wade ..... 473/158
2,057,504 A * 10/1936 Schafer ..... 473/162
3,540,733 A * 11/1970 Lamattina ..... 473/153
3,858,887 A * 1/1975 Wallin ..... 473/157
3,990,573 A * 11/1976 Cross ..... 190/115
4,017,084 A * 4/1977 Jeffery ..... 473/162
5,318,303 A * 6/1994 Kim ..... 473/160
5,720,667 A * 2/1998 Tu ..... 473/162
5,749,789 A * 5/1998 Karl ..... 473/162
7,294,062 B2 * 11/2007 Ting ..... 473/162
2003/0096658 A1 * 5/2003 Elliott ..... 473/162
2008/0020855 A1 * 1/2008 McDuffee ..... 473/162

* cited by examiner

*Primary Examiner*—Mark S Graham
(74) *Attorney, Agent, or Firm*—The Webb Law Firm

(57) ABSTRACT

Disclosed herein is a portable putting practice device, which is constructed so that a mat 30 is wound up in a roll to be stored in a box 20, and is unwound and pulled out of the box for use. The device includes foldable flexible guide walls which are provided on both side ends of the mat in a longitudinal direction thereof and prevent a golf ball from escaping from the mat when it is in use. When a user desires to store the mat in the box, the guide walls 40, 50 are unfolded outwards relative to left and right ends of the mat such that they are on the same plane as the mat. In this a state, the guide walls are wound. Meanwhile, when the user desires to use the mat 30, the mat is unwound and pulled out of the box 20.

5 Claims, 7 Drawing Sheets

(a)

(b)

(a)

(b)

(c)

PORTABLE PUTTING PRACTICE DEVICE

BACKGROUND OF THE INVENTION

1. Field of the Invention

The present invention relates generally to a portable putting practice device and, more particularly, to a portable putting practice device, which is capable of preventing a putting practice ball from escaping from a mat, and is constructed so that the mat is integrated with a box for storing the mat when wound up in a roll.

2. Description of the Related Art

Among various conventional portable putting practice devices, there are known putting practice devices, which are constructed so that a mat is rolled and is then stored in a vinyl or fabric bag or in a box-shaped case. Most such putting practice devices are disadvantageous in that the mat simply has the shape of a long flat sheet, so that a golf ball may roll off of the mat during putting practice. In order to prevent the golf ball from escaping from the mat, a fixed-type putting practice device has protruding steps on both ends of the mat in the longitudinal direction thereof. However, the fixed-type putting practice device is problematic in that it is impossible to roll the mat for storage.

SUMMARY OF THE INVENTION

Accordingly, the present invention has been made keeping in mind the above problems occurring in the prior art, and an object of the present invention is to provide a portable putting practice device, which maintains the advantage of a fixed-type putting practice device, which is capable of preventing a golf hall from escaping from a mat, and overcomes the disadvantage of the fixed-type putting practice device that cannot be rolled up for storage, and which is constructed so that guide walls are provided along edges of a mat in the longitudinal direction thereof so as to prevent the escape of the golf ball, and the mat can be rolled together with the flexible guide walls for storage.

Another object of the present invention is to provide a portable putting practice device, in which a box serving as a storage space for a mat is utilized as a piece of furniture. That is, the box which stores the rolled mat therein may also function as a chair, a sofa, etc.

A further object of the present invention is to provide a portable putting practice device, which allows a user to practice either long putting or short putting, as desired.

In order to accomplish the above objects, the present invention provides a portable putting practice device, including a hexahedral box which has left and right surfaces, upper and lower surfaces, and front and rear surfaces, a rotary rod which passes through the box in such a way that respective ends of the rotary rod are rotatably supported by the left and right surfaces of the box, a handle which extends from one end of the rotary rod in such a way as to protrude out of the box and functions to rotate the rotary rod, a mat which is secured at a first end thereof to the rotary rod, a second end of the mat being a free end which is pulled out through an opening formed in the front surface of the box, and a flexible guide wall which is foldably provided on each of side ends of the mat in a longitudinal direction thereof.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
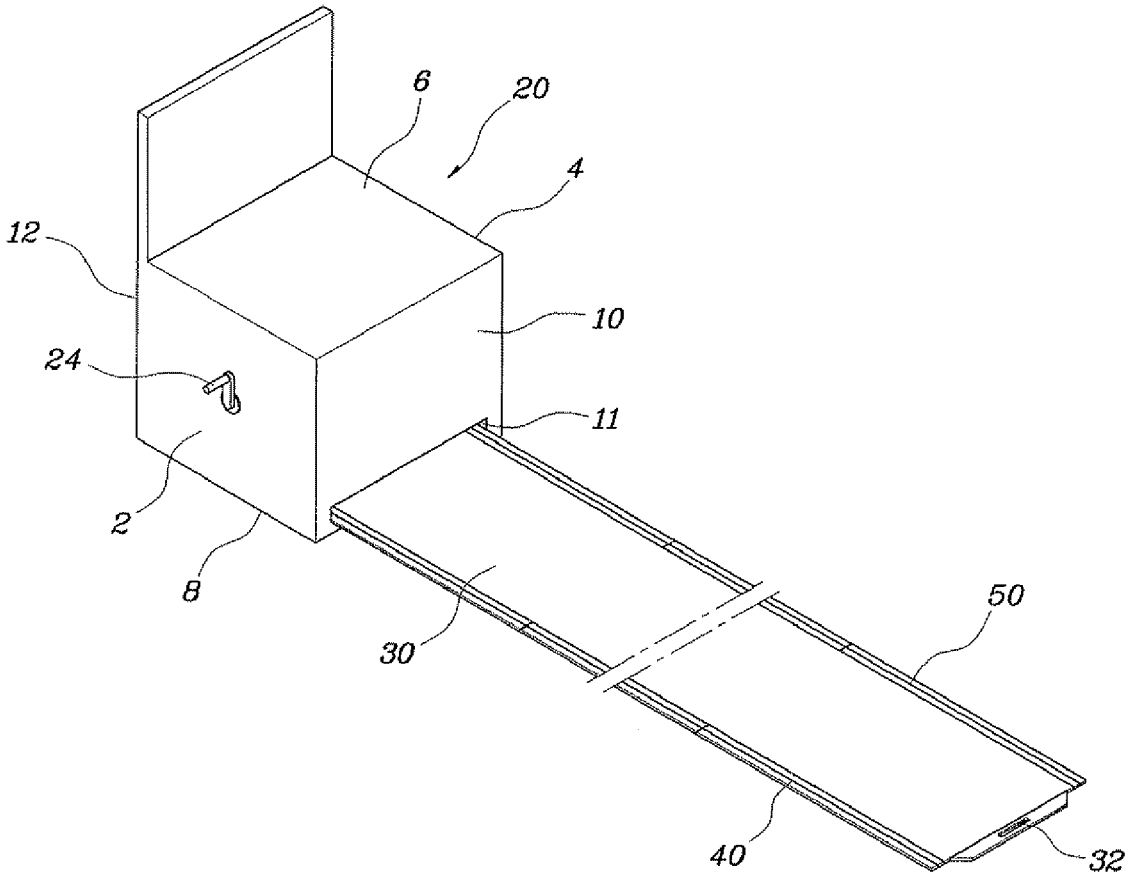
FIG. 1 is a perspective view showing the overall construction of a portable putting practice device, according to the first embodiment of the present invention.

Reference now should be made to the drawings, in which the same reference numerals are used throughout the different drawings to designate the same or similar components.

Figure 2:
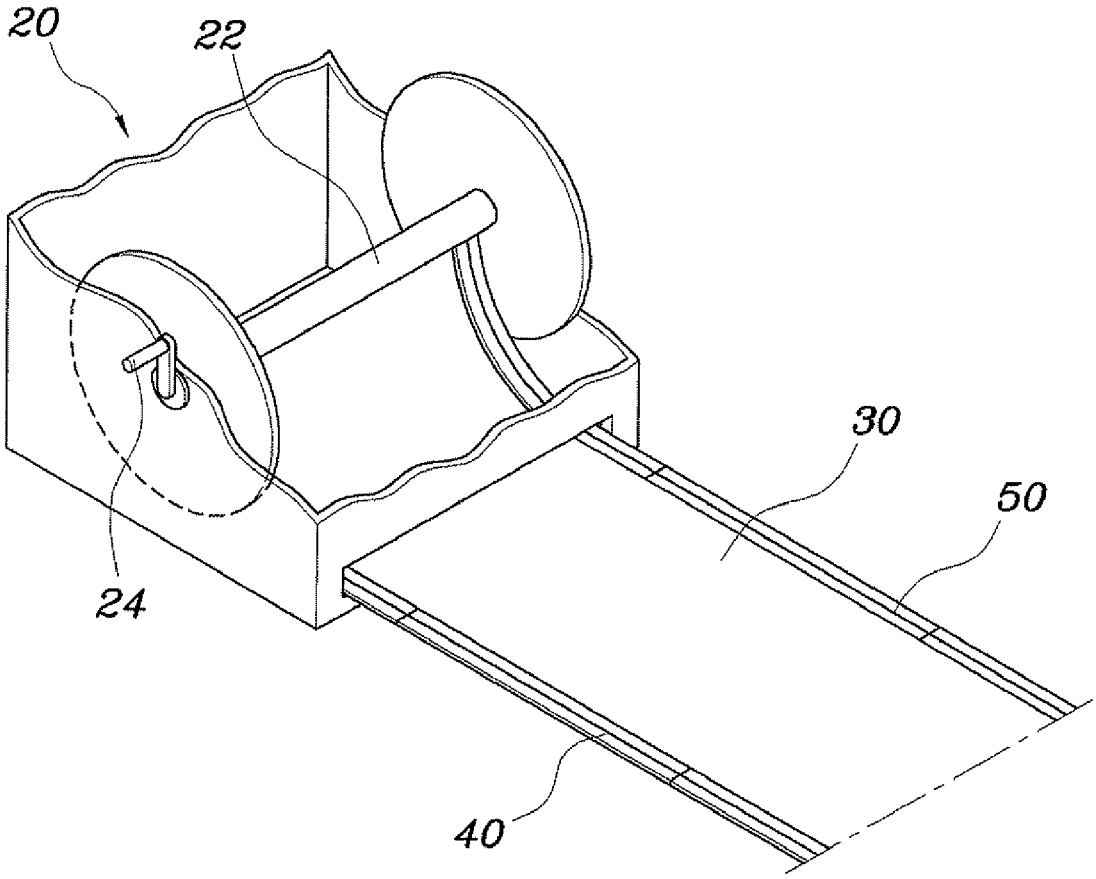
FIG. 2 is a cutaway perspective view of the portable putting practice device, according to the first embodiment of the present invention, in which one end of a mat is secured to the interior of a box so as to wind the mat.

As shown in FIGS. 1 and 2, a portable putting practice device according to the first embodiment of the present invention includes a hexahedral box 20, a rotary rod 22, a handle 24, a flexible mat 30, and flexible guide walls 40 and 50. The hexahedral box 20 has left and right surfaces 2 and 4, upper and lower surfaces 6 and 8, and front and rear surfaces 10 and 12. The rotary rod 22 passes through the box 20 such that both ends of the rotary rod 22 are rotatably supported by the left and right surfaces 2 and 4 of the box 20. The handle 24 extends from one end of the rotary rod 22 in such a way as to protrude out of the box 20, and functions to rotate the rotary rod 22. One end of the mat 30 is secured to and wound around the rotary rod 22, while the other end of the mat 30 is a free end, which is pulled out of the box 20 through an opening 11 which is formed in the front surface 10 of the box 20. The guide walls 40 and 50 are foldably provided on both side ends of the mat 30 in the longitudinal direction thereof.

When a user desires to store the portable putting practice device according to the present invention, the handle 24 is rotated such that the mat 30 is wound around the rotary rod 22 in the box 20. Meanwhile, when the user desires to use the mat 30, he or she holds a grip slit 32, formed in the free end of the mat 30, and pulls the mat 30 out from the box 20. Next, the guide walls 40 and 50, which are foldably provided on both side ends of the mat 30, are folded up and inwards relative to the mat 30, so that the putting practice device has a channel having a 'U'-shaped cross-section. The guide walls 40 and 50, which are set up on both side ends of the mat 30 in the longitudinal direction thereof, serve as fences which prevent a putting practice ball from escaping from the mat 30. To this end, it is preferable that the height H that each guide wall 40 or 50 protrudes from the upper surface of the mat 30 be equal to or greater than the radius r of the golf ball B.

Figure 3:
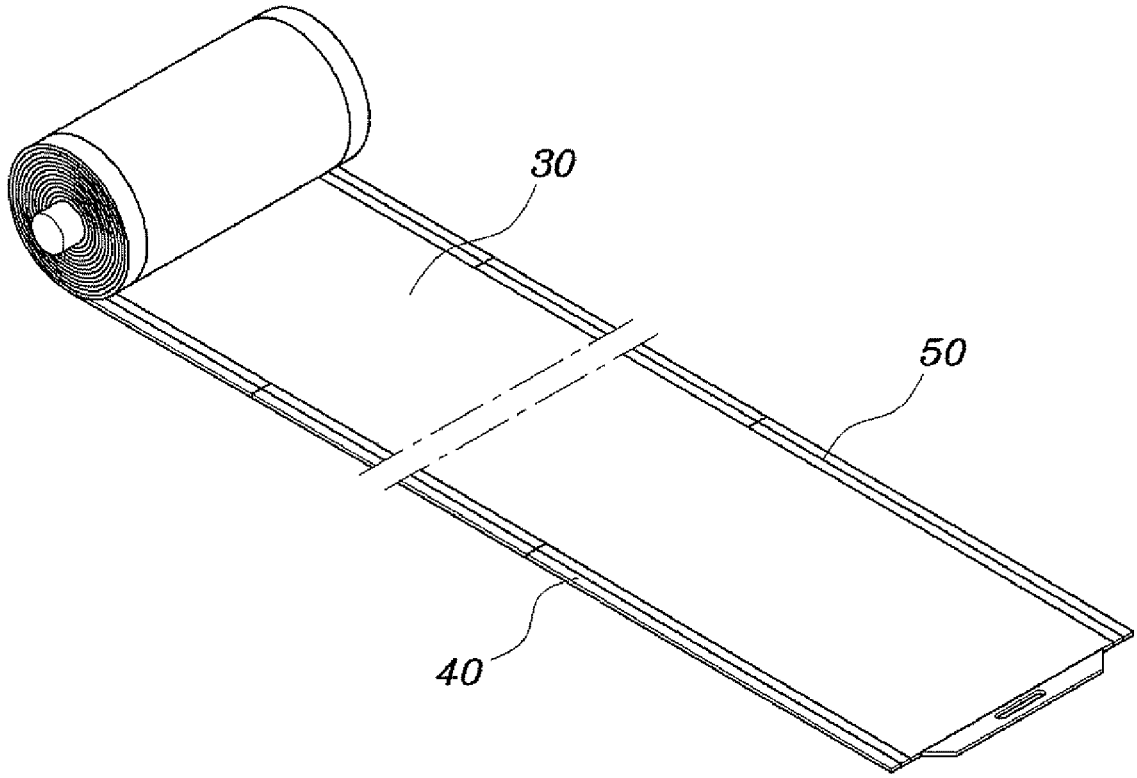
FIG. 3 is a perspective view showing the state in which the mat of the portable putting practice device according to the first embodiment of the present invention is being wound in a roll form.
Figure 4:
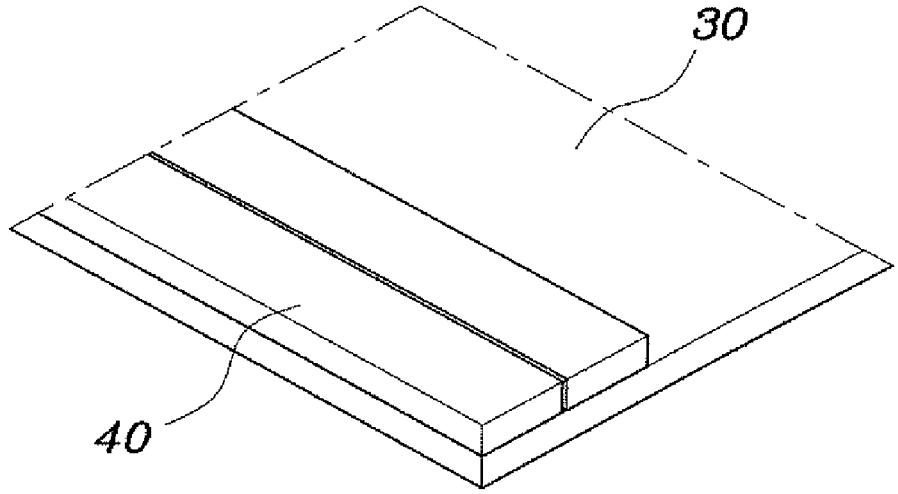
FIGS. 4*a* and 4*b* are enlarged perspective views showing the state in which a guide wall is folded up along one edge of the mat of the portable putting practice device according to the first embodiment of the present invention.
Figure 4:
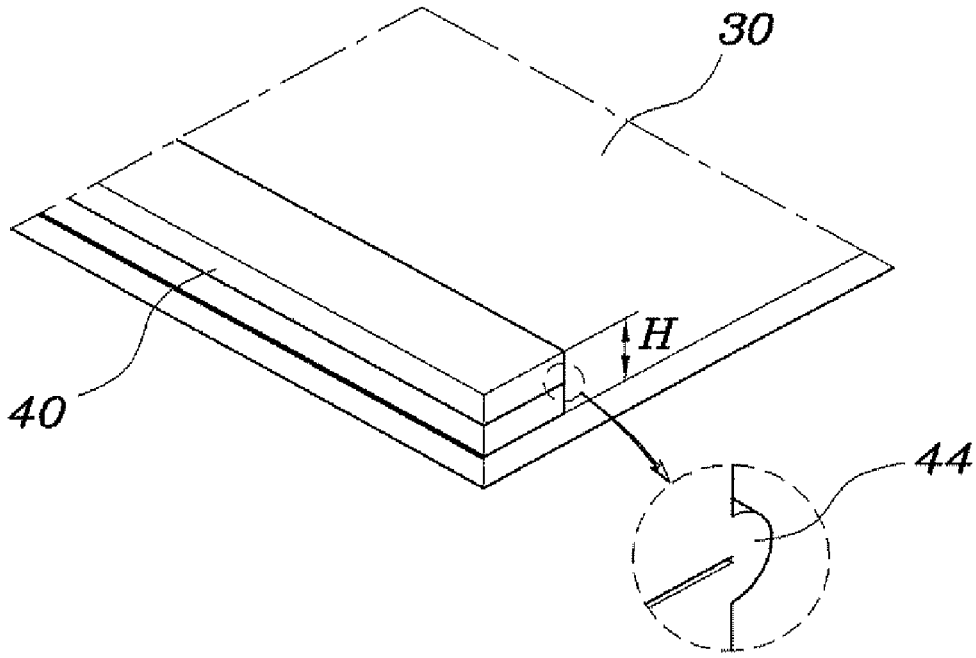

FIG. 3 is a view showing the mat 30 which is wound up in a roll, excluding the box 20 for storing the mat 30. FIGS. 4*a* and 4*b* are views showing the state in which, when the mat 30 is pulled out and used, the guide walls 40 and 50, foldably provided on the side ends of the mat 30 in the longitudinal direction thereof, are folded inwards relative to the mat 30 and thereafter are folded outwards relative to the mat 30, so that each guide wall 40 or 50 is folded up in two layers, thus forming the fence which has the height H and prevents the escape of the golf ball. As shown in the enlarged view of FIG. 4*b*, hinges 44 of each guide wall 40 or 50, which is folded up in multiple layers, are made of soft fabric.

Figure 5:
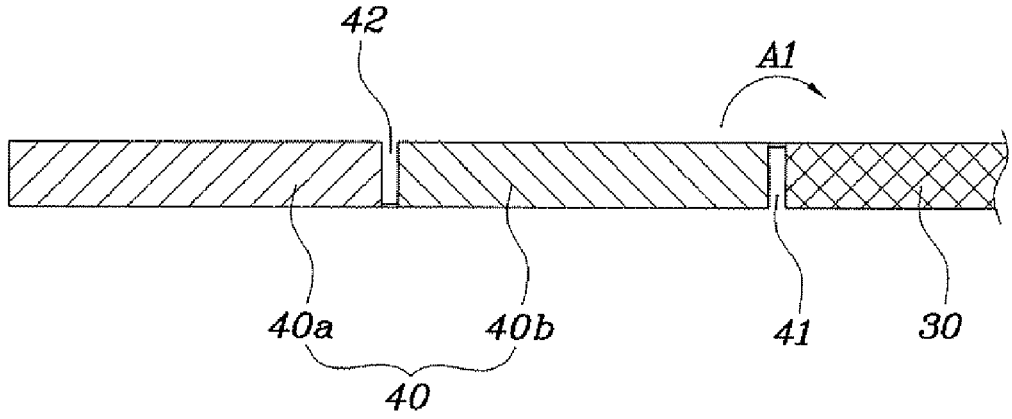
FIGS. 5*a* to 5*c* are sectional view showing the process of folding the guide wall along one edge of the mat of the portable putting practice device according to the first embodiment of the present invention.
Figure 5:
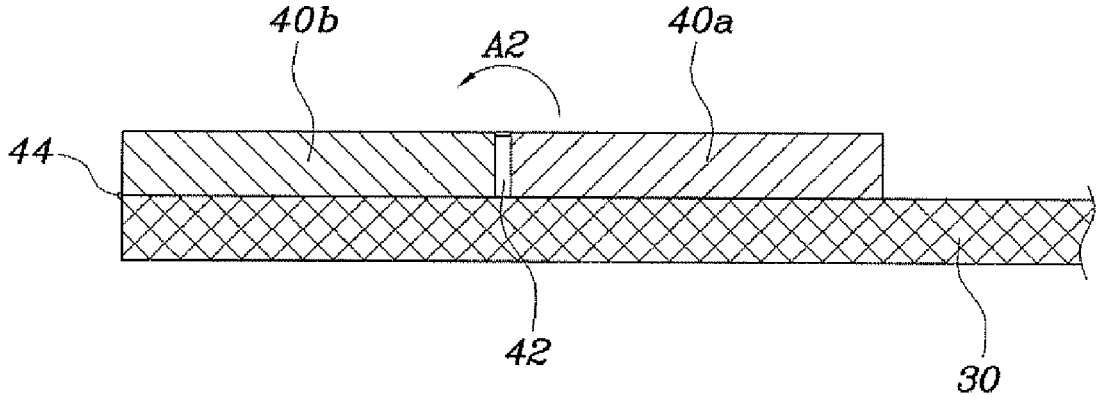
Figure 5:
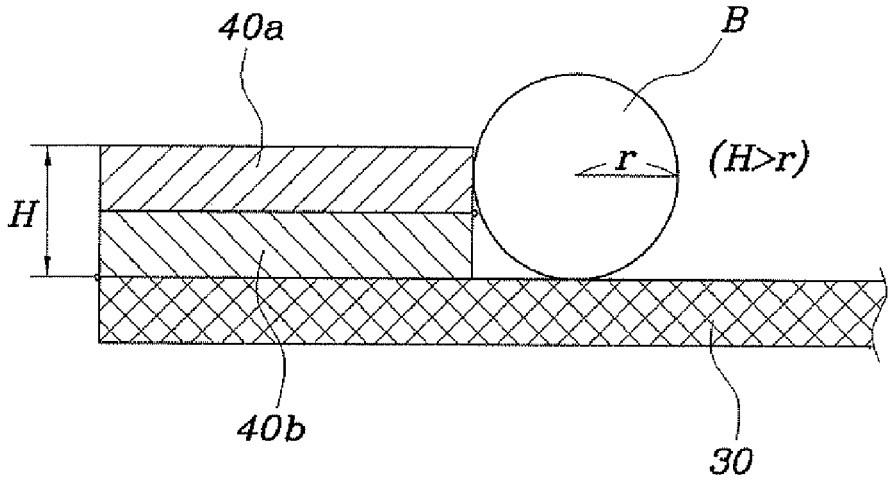

FIGS. 5*a* to 5*c* are views showing the mat 30 and the folded state of two wall parts 40*a* and 40*b* of the guide wall 40 which is foldably provided on one end of the mat 30, so as to illustrate the construction of the portable putting practice device according to the present invention in more detail.

FIG. 5*a* is a sectional view showing the initial state when the mat 30 is about to be wound around the rotary rod 22 (see FIGS. 1 and 2) for storage, or when the mat 30 is unwound from the rotary rod 22 and is pulled out of the box 20 for use. At this time, the wall parts 40*a* and 40*b* are unfolded outwards relative to the mat 30, so that the guide wall 40 is on the same level as the mat 30.

FIG. 5*b* is a sectional view showing the state in which, when a user desires to use the mat to practice putting, the two wall parts 40*a* and 40*b*, foldably coupled to the end of the mat 30, are folded inwards (shown by arrow A1) along the innermost folding line of FIG. 5*a*, that is, a first folding line 41. FIG. 5*c* is a view showing the state in which the inside wall part 40*a* is folded outwards (shown by arrow A2) along a second folding line 42 of FIG. 5*b*. FIG. 5*c* shows the state in which all of the wall parts 40*a* and 40*b* are folded, such that the guide wall 40 has the highest height. In this state, the portable putting practice device according to the present invention is used. According to this embodiment, the guide wall 40 includes the two wall parts 40*a* and 40*b* to form two layers. However, the guide wall of the present invention may have a single layer or three or more layers, according to the thickness and material of the mat and the guide wall, and is not limited a specific number of layers.

Figure 6:
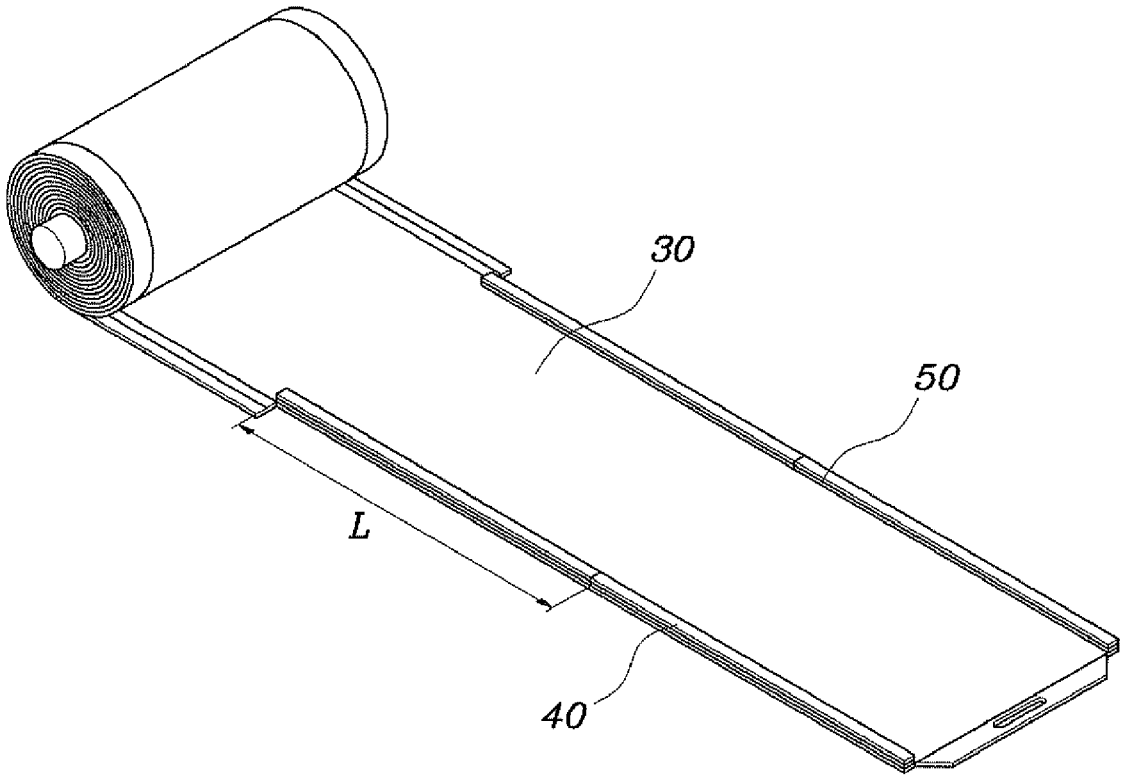
FIG. 6 is a perspective view showing the portable putting practice device according to the first embodiment of the present invention, in which each guide wall, foldably provided on the mat, is divided into several sections in the longitudinal direction of the mat at predetermined intervals.

FIG. 6 is a perspective view showing the guide wall which is divided into several sections in the longitudinal direction of the mat at predetermined intervals L. As shown in the drawing, since each guide wall 40 and 50 is divided into several sections in the longitudinal direction of the mat 30 at predetermined intervals L, only part of the guide wall may fold up within the length range of the mat 30 that is pulled out of the box 20, regardless of how much of the length of the mat 30 is pulled out of the box 20. This construction allows the portable putting practice device according to the present invention to be used to practice short putting as well as long putting. That is, when a user practices short putting, the guide walls 40 and 50 may be folded up within the length range of the mat 30 which is pulled out of the box 20.

Figure 7:
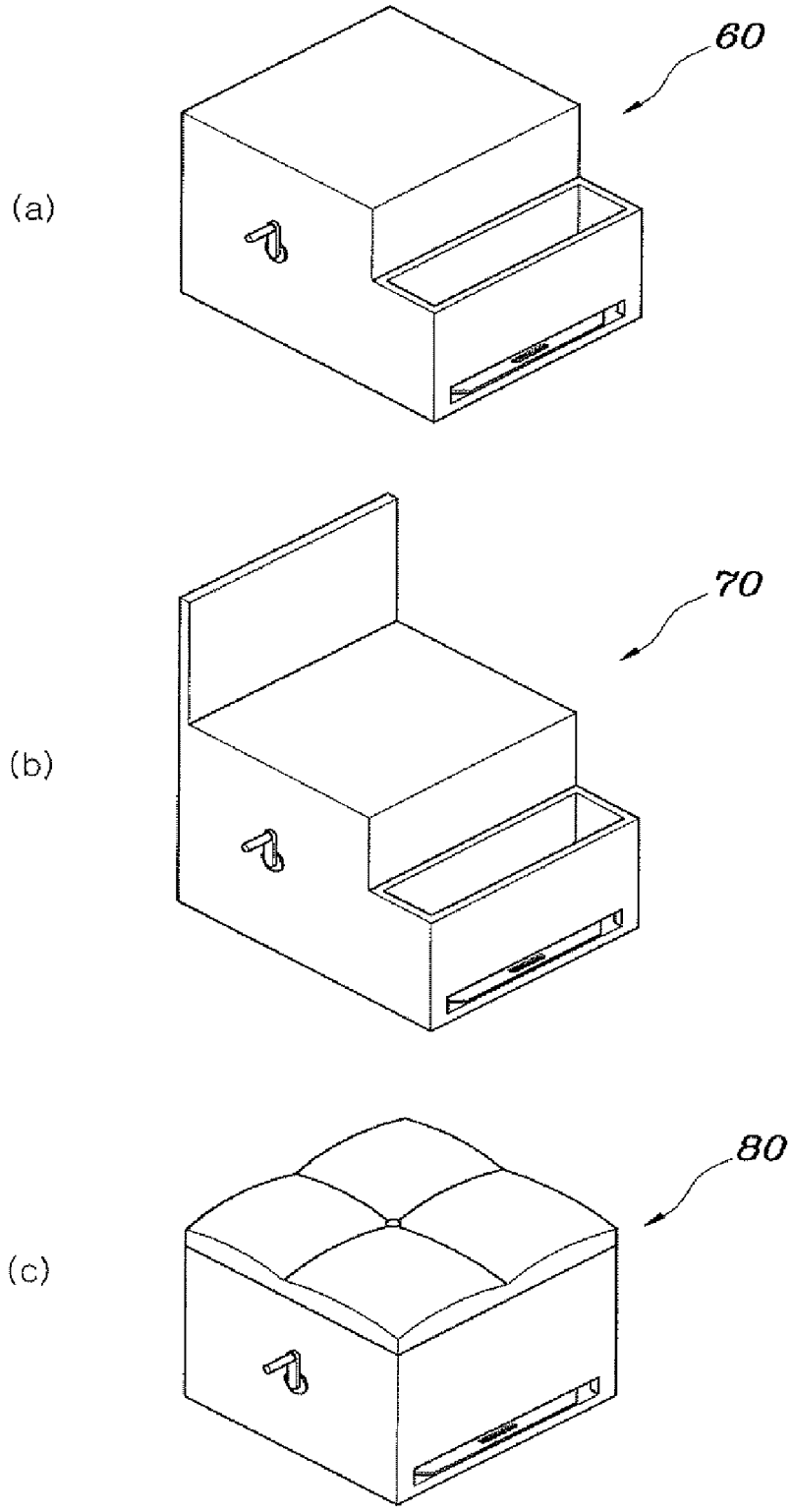
FIGS. 7*a* to 7*c* are views showing portable putting practice devices, according to other embodiments of the present invention, in which, when a mat is completely wound by rotating a handle and stored in a box, the box is used as a piece of furniture, that is, a multipurpose case, a chair, or a sofa having a cushion attached to the upper surface of the sofa.

FIGS. 7*a* to 7*c* are views showing the state in which, when the mat 30 is completely rolled by rotating the handle 24 and stored in the box 20, the box 20 is used as a piece of furniture, that is, a multipurpose case 60, a chair 70, or a sofa 80.

As described above, the present invention provides a portable putting practice device, which is capable of preventing a golf ball from escaping from a mat during putting practice, and allows the mat to be rolled for storage, thus being easy to carry, and allows a user to practice either long putting or short putting, as desired, and permits a box for storing the mat to be used as a piece of furniture, such as a chair.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A portable putting practice device, comprising:

a hexahedral box having left and right surfaces, upper and lower surfaces, and front and rear surfaces;

a rotary rod passing through the box in such a way that respective ends of the rotary rod are rotatably supported by the left and right surfaces of the box;

a handle extending from one end of the rotary rod in such a way as to protrude out of the box, and functioning to rotate the rotary rod;

a mat secured at a first end thereof to the rotary rod, a second end of the mat being a free end which is pulled out through an opening formed in the front surface of the box; and a flexible guide wall foldably provided on each of side ends of the mat in a longitudinal direction thereof, wherein, when the mat is wound around the rotary rod and is stored in the box in a roll form, the foldable guide wall is unfolded outwards relative to the side end of the mat, so that the guide wall is integrally wound together with the mat while the guide wall is on the same level as the mat, and, after the mat is unwound from the rotary rod and is pulled out of the box, the foldable guide wall is folded inwards relative to the side end of the mat in such a way as to protrude upwards from an upper surface of the mat, thus serving as a fence for preventing a putting practice ball from escaping from the mat.

2. The portable puffing practice device as set forth in claim 1, wherein the foldable guide wall is folded in two or more layers.

3. The portable putting practice device as set forth in claim 1, wherein the foldable guide wall is divided into several sections in the longitudinal direction of the mat at predetermined intervals.

4. The portable putting practice device as set forth in claim 1, wherein the rear surface of the box extends upwards to be higher than the upper surface of the box, so that the box forms a chair having a backrest.

5. The portable putting practice device as set forth in claim 1, wherein a cushion having elasticity is attached to the upper surface of the box, so that the box forms a sofa.

* * * * *

UNITED STATES PATENT AND TRADEMARK OFFICE

CERTIFICATE OF CORRECTION

PATENT NO. : 7,556,566 B2
APPLICATION NO. : 12/031216
DATED : July 7, 2009
INVENTOR(S) : Ick Hwan Shin It is certified that error appears in the above-identified patent and that said Letters Patent is hereby corrected as shown below:

Column 4, Claim 2, Line 45, "portable puffing practice" should read
-- portable putting practice --

Signed and Sealed this

Third Day of November, 2009

David J. Kappos

David J. Kappos
*Director of the United States Patent and Trademark Office*